US007101437B2

(12) United States Patent
Boutilier et al.

(10) Patent No.: US 7,101,437 B2
(45) Date of Patent: Sep. 5, 2006

(54) ELEMENTS FOR EMBOSSING AND ADHESIVE APPLICATION

(75) Inventors: Glenn David Boutilier, Cincinnati, OH (US); Linda Evers-Smith, Fayetteville, OH (US); Jeffrey Scott Ledford, Lincoln University, PA (US); Timothy Jude Lorenz, Cincinnati, OH (US); Michael Gomer Stelljes, Jr., Mason, OH (US); John William Toussant, West Chester, OH (US); Paul Dennis Trokhan, Hamilton, OH (US); Andrew Julian Wnuk, Wyoming, OH (US); Paul Anthony Zaffiro, Middletown, OH (US); Dean Arthur Zimmerman, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 396 days.

(21) Appl. No.: 10/389,441

(22) Filed: Mar. 14, 2003

(65) Prior Publication Data

US 2003/0218274 A1 Nov. 27, 2003

Related U.S. Application Data

(60) Provisional application No. 60/387,710, filed on Jun. 11, 2002, provisional application No. 60/364,713, filed on Mar. 15, 2002.

(51) Int. Cl.
*B05C 1/08* (2006.01)

(52) U.S. Cl. ..... 118/211; 118/212; 118/DIG. 14; 118/DIG. 15; 492/56; 101/22; 101/23; 101/28; 425/363; 425/373; 425/471

(58) Field of Classification Search ..... 118/211, 118/212, 249, DIG. 14, DIG. 15; 492/56; 101/5, 6, 22, 23, 28; 428/195.1; 425/363, 425/373, 471

See application file for complete search history.

(56) References Cited

U.S. PATENT DOCUMENTS

| | | | | |
|---|---|---|---|---|
| 3,605,194 | A | 9/1971 | Nauta | |
| 3,953,638 | A * | 4/1976 | Kemp | 428/154 |
| 4,211,743 | A | 7/1980 | Nauta et al. | 264/284 |
| 5,017,432 | A | 5/1991 | Eddy et al. | 428/422 |
| 5,217,837 | A | 6/1993 | Henry et al. | 430/124 |
| 5,219,612 | A | 6/1993 | Bingham et al. | 427/194 |
| 5,235,003 | A | 8/1993 | Ward et al. | 525/476 |
| 5,428,123 | A | 6/1995 | Ward et al. | 128/28 |
| 5,430,533 | A | 7/1995 | Dreyfuss et al. | 355/273 |
| 5,471,291 | A * | 11/1995 | Janes et al. | 399/302 |
| 5,589,563 | A | 12/1996 | Ward et al. | 528/44 |
| 5,756,632 | A | 5/1998 | Ward et al. | 528/28 |
| 5,876,853 | A | 3/1999 | Gallant | 428/423.3 |
| 5,997,456 | A * | 12/1999 | Butters et al. | 492/56 |
| 6,183,079 | B1 * | 2/2001 | Meade et al. | 347/101 |
| 6,193,918 | B1 | 2/2001 | McGuire et al. | 264/167 |
| 6,361,601 | B1 * | 3/2002 | Schulz | 118/70 |

* cited by examiner

OTHER PUBLICATIONS

Technical Bulletin, VIBRATHANE 6060, A Liquid Urethane Prepolymer (undated).*

*Primary Examiner*—Laura Edwards
(74) *Attorney, Agent, or Firm*—David K. Mattheis; Stephen T. Murphy; Leonard W. Lewis

(57) ABSTRACT

A patterned element for use in an embossing and adhesive application process. The patterened element comprises a material having an pattern disposed thereon, wherein the material comprises a polymer and has a Shore A hardness of greater than about 70, and has a critical surface energy of less than about 30 dynes/cm.

8 Claims, 3 Drawing Sheets

ELEMENTS FOR EMBOSSING AND ADHESIVE APPLICATION

This Application claims priority under 35 U.S.C. §119(e) to U.S. Provisional Patent Application Ser. No. 60/364,713 filed in the names of Boutilier, et al. on Mar. 15, 2002 and to U.S. Provisional Patent Application Ser. No. 60/387,710 filed in the names of Boutilier, et al. on Jun. 11, 2002.

FIELD OF THE INVENTION

The present invention relates to patterned elements, processes for using patterned elements and improvements in patterned elements suitable for embossing and applying an adhesive to a sheet of web material.

BACKGROUND OF THE INVENTION

Three-dimensional sheet materials which include a thin layer of pressure-sensitive adhesive protected from inadvertent surface contact, as well as methods and apparatus for manufacturing them, have been developed and are described in detail in commonly-assigned patents, Hamilton et al., U.S. Pat. No. 5,662,758, entitled "Composite Material Releasably Sealable to a Target Surface When Pressed Thereagainst and Method of Making", Hamilton et al., U.S. Pat. No. 5,871,607, entitled "Material Having A Substance Protected by Deformable Standoffs and Method of Making", McGuire et al., U.S. Pat. No. 5,965,235, entitled "Three-Dimensional, Nesting-Resistant Sheet Materials and Method and Apparatus for Making Same", and Hamilton et al., U.S. Pat. No. 6,194,062, entitled "Improved Storage Wrap Materials" and McGuire et al., U.S. Pat. No. 6,193,918, entitled "High Speed Embossing and Adhesive Printing Process and Apparatus".

While the processes and equipment for manufacturing such pressure sensitive, adhesive-coated materials described in these patents are suitable for manufacturing, the nature of the processes and equipment can be sensitive to the materials used in the different machine components. Said differently, individual components of the process may cause problems in the production of pressure sensitive, adhesive-coated materials. One example of this is the embossing rolls used in the prior art processes. These are typically engraved steel rolls coated with a thin release coating (typically less than 2 thousandths of an inch). These coatings are necessary on steel rolls to provide release of the adhesive. While these prior art rolls are suitable for use in the prior art processes, they are less than ideal. In use, the coatings on the rolls are subject to chipping, delamination and abrasive wear resulting in typical coating lifetimes of less than 50 hours. As a result of this deterioration of the roll coating, the rolls cause quality and/or downtime problems from either web tears or pinholes in the adhesive-coated materials. Pinholes occur either due to a sharp edge on an abrasion or from pinching of an abraded edge between the second and first roll. Pinholes reduce the barrier properties of the film and large pinholes can result in fluid leakage. This premature roll coating wear must be corrected by a more frequent replacement of the rolls on the production line.

Replacing the rolls are difficult as well. The high temperatures involved in the recoating of the rolls can result in coatings with poor repeatability making it difficult to qualify new rolls. Also, new rolls are typically made by a mill engraving process which is time-consuming and expensive.

All of these factors result in a significant reduction of reliability and efficiency at which the process and apparatus can be operated, and the reliability and efficiency of such processes and apparatus are is a major factor in the economics of producing such materials on a commercial scale.

Accordingly, it would be desirable to provide a patterned element which has superior durability, and as a result minimizes or eliminates web tears and pinholing, and has good repeatability.

SUMMARY OF THE INVENTION

In accordance with a first aspect of the present invention, a patterned element for use in an embossing and adhesive application process is provided. The surface of the patterned element comprises a material having a pattern disposed thereon, wherein the material comprises a polymer and has a Shore A hardness of greater than about 70, and has a critical surface energy of less than about 30 dynes/cm.

In accordance with a second aspect of the present invention, a method for embossing and applying an adhesive to a substrate is provided. The method comprises the steps of:

(a) supplying a first embossing roll whose surface comprises a material and having a first embossing pattern disposed thereon, wherein the first embossing roll is engaged with a second embossing roll, the second embossing roll having a second embossing pattern disposed thereon, the first embossing pattern and the second embossing pattern being complementary, wherein the material of the first embossing roll comprises a polymer and has a Shore A hardness of greater than about 70, and has a critical surface energy of less than about 30 dynes/cm;

(b) applying the adhesive to the first embossing roll; and (c) passing a substrate of sheet material between the first and second embossing rolls to simultaneously emboss the substrate thereby forming a pattern of valleys and land areas and apply the adhesive to the substrate, such that the adhesive forms an adhesive pattern on the valleys between the land areas.

In accordance with a third aspect of the present invention, a method for embossing and applying an adhesive to a substrate is provided. The method comprises the steps of:

(a) supplying a first embossing roll whose surface comprises a material having a first embossing pattern disposed thereon, wherein the first embossing roll is engaged with a second embossing roll, the second embossing roll having a second embossing pattern disposed thereon, the first embossing pattern and the second embossing pattern being complementary, wherein the material comprises a polymer and has a Shore A hardness of greater than about 70, and has a critical surface energy of less than about 30 dynes/cm;

(b) applying an adhesive to the first embossing roll;

(c) contacting a substrate of sheet material with the first embossing roll after step (b), whereby the adhesive forms an adhesive pattern on the substrate of sheet material in register with the first embossing pattern of the first embossing roll; and, (d) passing the substrate of sheet material between the first embossing roll and the second embossing roll wherein the first embossing roll and the second embossing roll emboss the substrate with the complementary embossing pattern thereby forming a pattern of valleys and land areas such that the adhesive pattern is on the valleys between the land areas.

All patents, articles, documents, and other materials cited are, in relevant part, incorporated herein by reference; the citation of any document is not to be construed as an admission that it is prior art with respect to the present invention.

All percentages, ratios and proportions are by weight, and all temperatures are in degrees Celsius (° C.), unless otherwise specified. All measurements are in SI units, unless otherwise specified.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

1) Patterned Element

Figure 1:
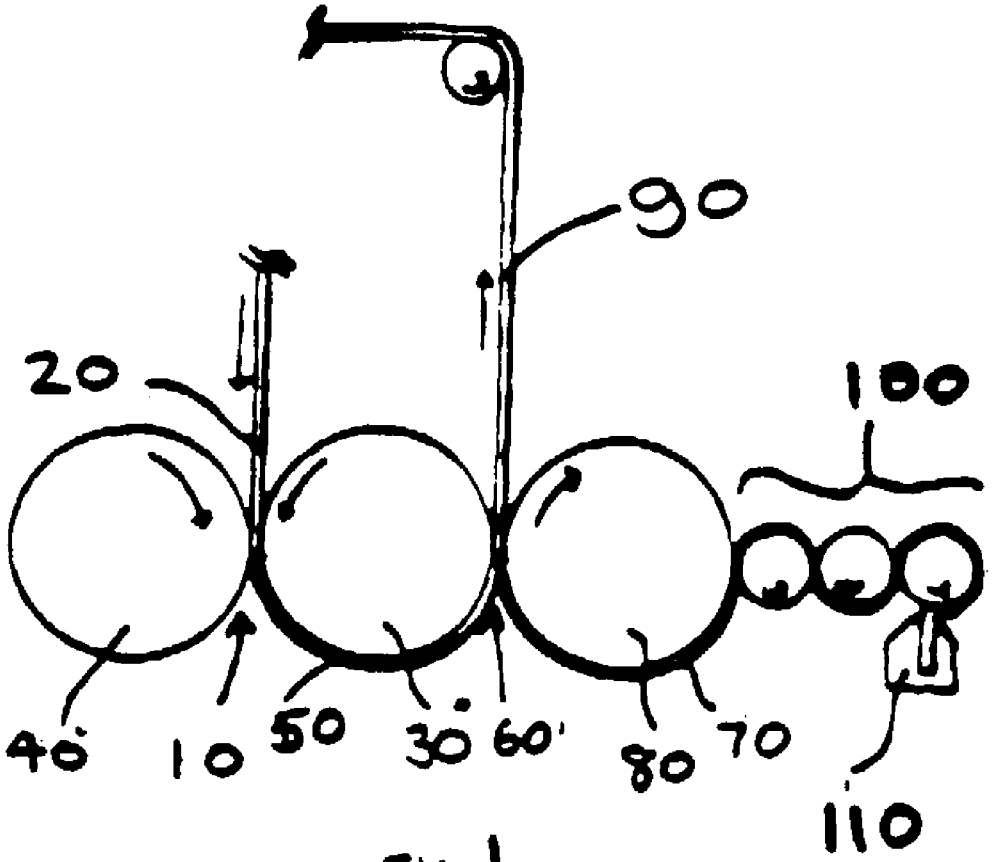
FIG. 1 is a schematic illustration of a simple embossing and adhesive printing process and apparatus.

The patterned elements of the present invention may be used in a variety of embossing processes, especially high speed embossing. The processes, apparatus and methods described in U.S. Pat. Nos. 5,662,758; 5,871,607; 5,965,235; 6,254,965; 6,194,062; and 6,193,918, are illustrative of embossing processes apparatus and methods in which the patterned element of the present invention is suitable for.

In one embodiment of the present invention, the element is selected from the group consisting of a roll and a continuous belt. The belt would be used in combination with vacuum to produce embossing on any substrate. Another alternative would be the use of a belt and a roll, each with a complimentary pattern to produce embossing of a substrate. Illustrative, but non-limiting, examples of embossing process using a continuous belt can be found in U.S. Pat. Nos. 5,965,235, 6,254,965, 6,194,062. Similarly, illustrative, but also non-limiting examples of an embossing process using an embossing roll can be found in U.S. Pat. No. 6,193,918.

In one embodiment of the present invention the patterned element is a patterned roll and the material surrounds a curved body of a cylindrical core. That is, the material is the outer or surface layer of a patterned roll. The cylindrical core is typically selected from metal, ceramic, polymer, composite material or the like. In one alternative embodiment the patterned element is a patterned roll comprising a metal core whose curved body is surrounded by the material. The optional use of this two layer patterned roll provides added benefits. Namely, when the material has reached the end of its useful life it can be removed from the cylinder, new material added and then the pattern is added.

In another alternative embodiment of the present invention the patterned roll comprises only the material. That is, the patterned roll is made of only the material, for example, by casting the roller in a patterning mold. However, patterned rollers that comprise only material are not limited to only those that can be produced through the use of molds.

The material of the present invention comprises a polymer. The material has a Shore A hardness of greater than about 70, preferably greater than about 80. The process for determining the Shore A hardness is described hereafter. Furthermore, the material of the present invention has a critical surface energy of less than about 30 dynes/cm, preferably less than about 24 dynes/cm. The process for determining critical surface energy is also described hereafter.

In one alternative embodiment of the present invention the material has a Taber abrasion weight loss, as explained in detail hereafter, of preferably less than about 300 mg, more preferably less than about 200 mg.

In another alternative embodiment of the present invention the material preferably has a surface roughness, Ra, as explained in detail hereafter, of less than about 30 microinches (0.8 microns), more preferably less than about 15 microinches (0.4 microns).

In another alternative embodiment of the present invention the material preferably has a peel strength, as explained in detail hereafter, of less than about about 500 g/in, more preferably less than about 250 g/in, even still more preferably less than about 150 g/in.

In one embodiment of the present invention the material comprises a polymer. The polymer may be a thermoset polymer or a thermoplastic polymer. Suitable illustrative polymers include, but are not limited to silicones, fluoropolymers, polyurethane, nitrile rubbers, isoprene rubber, thermoplastic elastomers, ethylene-propylene (EP) rubber, styrene-butadiene rubber (SBR), ethylene-propylene-diene monomer (EPDM), epoxides, polychloroprene and mixtures thereof. In one embodiment of the present invention, the polymers are copolymers containing silicone and/or fluorine. For example the polymers listed previously, that is silicones, fluoropolymers, chlorosulfonated polyethylene, polyurethane, nitrile rubbers, isoprene rubber, thermoplastic elastomers, ethylene-propylene (EP) rubber, styrene-butadiene rubber (SBR), ethylene-propylene-diene monomer (EPDM), epoxides, polychloroprene and mixtures thereof, contain copolymer units which contain silicone and/or fluorine. Examples of this are fluorine copolymers such as hexafluoropropylene-vinylidene fluoride copolymer (HFP/VDF), fluorinated ethylene-propylene copolymer (FEP), ethylene-chlorotrifluoroethylene copolymer (ECTFE), perfluoroalkyl-tetrafluoroethylene copolymer (PFA), urethane-fluorine copolymers; silicone copolymers including fluorosilicones; and urethane-silicone copolymers. Especially suitable polymers and copolymers include, but are not limited to, fluorinated polymers and copolymers, urethane fluorine copolymers, silicone polymers and copolymers, modified polyurethanes, including those with silicone in the backbone (silicone-urethane copolymers) or silicone surface modifying end groups, and the like. Combinations of these especially suitable polymers and copolymers are also within the scope of the present invention.

Additional suitable polymers may be found in U.S. Pat. Nos. 5,235,003; 5,428,123; 5,589,563; and 5,756,632.

In one embodiment of the present invention the material is wholly comprised of a polymer.

In one embodiment of the present invention the material may further comprise optional ingredients, such as, a critical surface energy reducer. Typically, a critical surface energy reducer is included in the material to reduce the critical surface energy of the material to the requisite critical surface energy of less than about 30 dynes/cm. For example, in the situation when the material is a polymer that has a critical surface energy greater than about 30 dynes/cm then incorporation of a critical surface energy reducer to lower the critical surface energy of the resulting mixture to less than about 30 dynes/cm is necessary. The critical surface energy reducer may either be mixed with the material or applied externally using a brush, roller, sprayer or the like. However, it is also within the scope of the present invention to incorporate critical surface energy reducer into material which has a critical surface energy of less than about 30 dynes/cm even prior to incorporation of the critical surface energy reducer. Suitable critical surface energy reducer includes, but is not limited to, oils, waxes, gums, resins, or particles containing silicone and/or fluorine and combinations thereof. Particularly advantageous are silicone oils based on polydimethylsiloxane. These critical surface energy reducers are incorporated into the material in a sufficient amount to reduce the critical surface energy of the material to the level desired.

The surface of the material may also be modified to reduce the critical surface energy, for example, by plasma coating with fluorine.

The material of the present invention may also include other optional ingredients such as filler, antioxidants, stabilizers, surfactants, and the like.

In one embodiment of the present invention the patterned element preferably has the best combination of adhesion and release characteristics such as would be required for a patterned and adhesive application process. Furthermore, the characteristics of the patterned element can be optimized with respect to the particular adhesive and/or substrate used in a particular embossing and adhesion process.

In one alternative embodiment of the present invention the patterned element is internally cooled to a temperature that assists the patterned material's release of the adhesive-coated substrate from the patterned element. This temperature would depend upon several factors, including, but not limited to, the substrate material, line speed, adhesive selected, material, etc. Alternately, these results could be achieved by heating the patterned element such that the adhesive separates from the element in either a cohesive or adhesive manner and then selectively cooling the embossed adhesive coated substrate after removal from the patterned element. Heaters would be known to one skilled in the art to include radiant, conductive, convective, and combinations thereof.

The patterned elements of the present invention have a pattern disposed thereon. The pattern disposed on the material may be any suitable pattern which is suitable for adhesive application on to a substrate in a pattern, or embossing of a substrate or both. Typically, the pattern is a continuous raised surface on the material. In one embodiment of the present invention the pattern is suitable for both application of adhesive to and embossing of a substrate. Any suitable pattern may be used, such as those created using an algorithm described in greater detail in U.S. application Ser. No. 09/288,736, entitled "Method of Seaming and Expanding Amorphous Patterns", filed on Apr. 9, 1999 (P&G Case 7492). Other suitable patterns, especially embossing patterns, can be found in U.S. Pat. Nos. 5,662,758; 5,871,607; 5,965,235; 6,194,062; and 6,193,918.

The patterned elements of the present invention can be made in any suitable fashion. Namely, the material can be, for example, cast, molded, sprayed on to a core and then polymerized/cured or a shrink sleeve can be applied. Once the element has been formed, the pattern can be put on to the material in any suitable fashion. For example, the pattern can be put on the material by machining, laser engraving, etching and the like.

Nothing in this specification is to be construed in any fashion to limit the patterned elements of the first aspect of the present invention to use in only the processes of the second aspect or third aspects of the present invention, which are explained in detail hereafter. The patterned elements of the present invention are suitable for use in any adhesive application process or embossing and adhesive application process.

One such alternative embossing and adhesive application process is shown in FIG. 1. At station 10, a web of sheet material 20 is passed between first and second embossing rolls 30, 40, having complementary or mating embossing patterns, at a tangential line speed to form an embossed pattern on a web of sheet material 20. The embossed web 50 is maintained on the first embossing roll 30. At station 60, adhesive 70 is applied to the recesses of the embossed web 50. The adhesive 70 is applied by a patterned adhesive application roll 80 having a complementary pattern to the embossed pattern of embossed web 50 as established by first embossing roll 30. The patterned adhesive application roll 80 comprises a material with a Shore A hardness of greater than about 70, and has a critical surface energy of less than about 30 dynes/cm. The adhesive coated and embossed web of sheet material 90 is then removed from between the first patterned adhesive roll 80 and the first embossing roll 30.

The patterned adhesive application roll 80 is coated with adhesive, preferably from a multi-roll adhesive coater stack 100 and slot die 110, as described hereinafter or by any other means known to those of skill in the art.

The process for embossing and adhesive printing of FIG. 1 provides a benefit because the patterned adhesive application roll 80 is not required to perform an embossing function. Thus, the characteristics of patterned adhesive application roll 80 can be optimized for the application and release of adhesive 70 without regard to the impact on embossing. In particular, the patterned adhesive application roll 80 does not require a high tolerance fit with the first patterned embossing roll 40 nor is it exposed to the high pressures for embossing. Therefore, less strain results on the release surfaces resulting in longer life of the patterned adhesive application roll 80.

Also included within the scope of the present invention are methods for embossing and applying an adhesive to a substrate using the embossing element according to the first aspect of the present invention. The embossed adhesive coated substrates prepared according to these methods are also within the scope of the present invention.

2) Methods for Embossing and Applying Adhesive to a Web.

Figure 2:
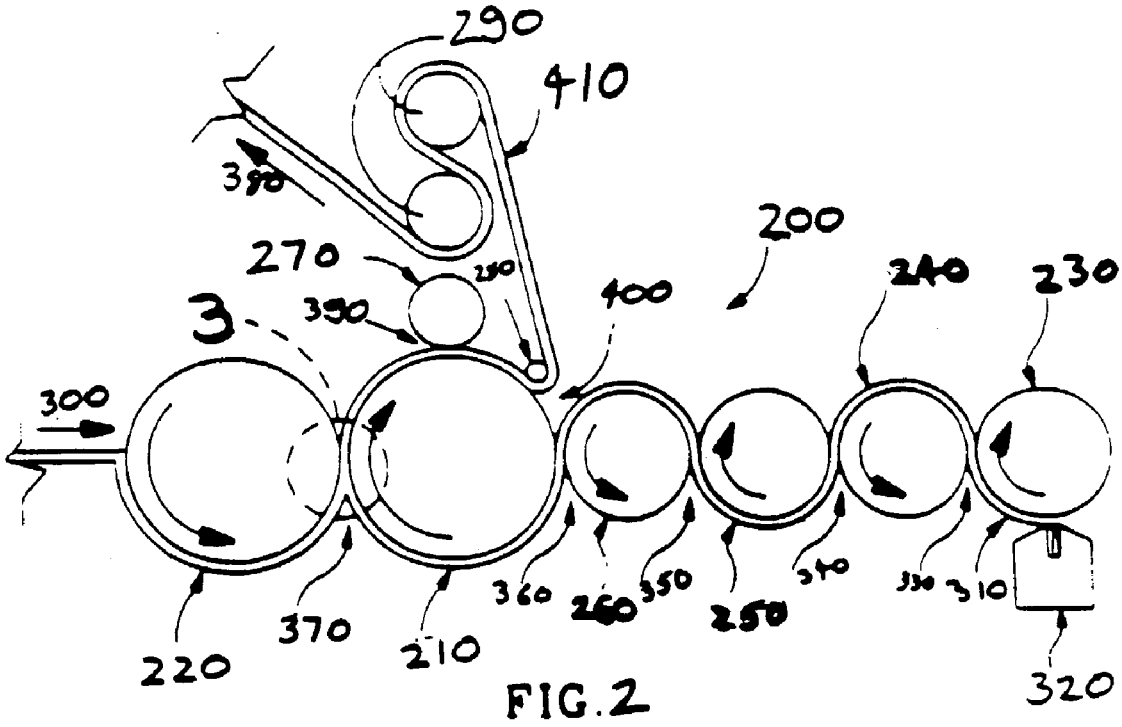
FIG. 2 is a schematic illustration of an embossing and adhesive printing process and apparatus according to the second aspect of the present invention.

The second embodiment of the present invention is directed to a method for simultaneously embossing and applying adhesive to a web. FIG. 2 illustrates in schematic form a high speed embossing process and high speed embossing apparatus 200 of the second embodiment of the present invention. The high speed embossing apparatus 200 comprises first and second embossing rolls designated 210, 220, respectively a plurality of adhesive metering application rolls 230–260, a pressure roll 270, a strip-off roll 280, and an S-wrap 290. The first and second embossing rolls 210, 220 have a complementary (i.e., matched) embossing pattern which interlocks to emboss the pattern onto a web of sheet material 300 passed therebetween. The embossing roll provided with valleys and land areas (connected) is generally referred to as the female or first embossing roll. The embossing roll with raised discrete, non-connected nubs is generally referred to as the male or second embossing roll.

As shown in FIG. 2, the high speed embossing apparatus will typically comprise a plurality of adhesive application metering rolls 230, 240, 250, 260 that supply a metered amount of adhesive 310 to first embossing roll 210 from an adhesive supply. The application metering rolls 230–260 preferably have alternating hardness. As a non-limiting example, first adhesive application metering roll 230 can be steel and adjacent adhesive application metering roll 240 can be rubber-coated or other conformable surface. Although numerous configurations are possible, it is preferred that every other roll of the plurality of adhesive application metering rolls 230–260 have a conformable surface. In any event, adhesive application metering roll 260 should be conformable since it is contacting first embossing roll 210.

FIG. 2 depicts with arrows, an exemplary and non-limiting, direction of roll rotation for each roll. More specifically, with reference to FIG. 2, an adhesive 310 is extruded onto the surface of the first adhesive application metering roll 230 via a slot die 320. Exemplary, but non-limiting adhesives include hot melt, pressure sensitive, water-based, water-borne, solvent-based, ultraviolet and e-beam cured adhesives, and combinations thereof. It is preferred that slot die 320 be heated and supplied by a hot melt adhesive supply system, which can include a heated tank and variable speed gear pump (not shown) through a heated hose. However, it would be known to one of skill in the art that other methods to supply an adhesive 310 to first adhesive application metering roll 230 can be used.

The surface speed of the first adhesive application metering roll 230 is generally considerably slower than the nominal tangential line speed of the web of sheet material 300 to be embossed and coated. The metering nips are shown in FIG. 2 as stations 330, 340, and 350. The remaining adhesive application metering rolls 240–260 then rotate progressively faster so that the adhesive application nip, station 360, is surface speed matched with the surface speed of traversing web of sheet material 300. The adhesive 310 is then transferred from the final adhesive application metering roll 260 to the first embossing roll 210, located at station 360. The adhesive 310 travels on the surface of first embossing roll 210 to station 370, where adhesive 310 is combined with the web of sheet material 300 which is carried into station 370 via the second embossing roll 220.

At station 370, the web of sheet material 300 is embossed and combined with the adhesive 310 simultaneously by first and second embossing rolls 210, 220 with the complementary embossing pattern thereon to form an embossed adhesive coated web 380. This results in the embossing pattern being in register with the adhesive pattern of first embossing roll 210. The embossed adhesive coated web 380, now adhered to the surface of the first embossing roll 210, next travels on the surface of first embossing roll 210 to station 390, where a pressure roll 270 applies pressure to the embossed adhesive coated web 380. The embossed adhesive coated web 380, still adhered to the first embossing roll 210, next travels to station 400, where it is removed from the first embossing roll 210 via strip-off roll 280. The finished embossed adhesive coated web 380 then travels to the S-wrap 290 at station 410. As would be known to one of skill in the art, the embossed adhesive coated web 380 can be further strengthened by supplying additional cooling to the embossed adhesive coated web 380 at stations 390 and 400.

Figure 3:
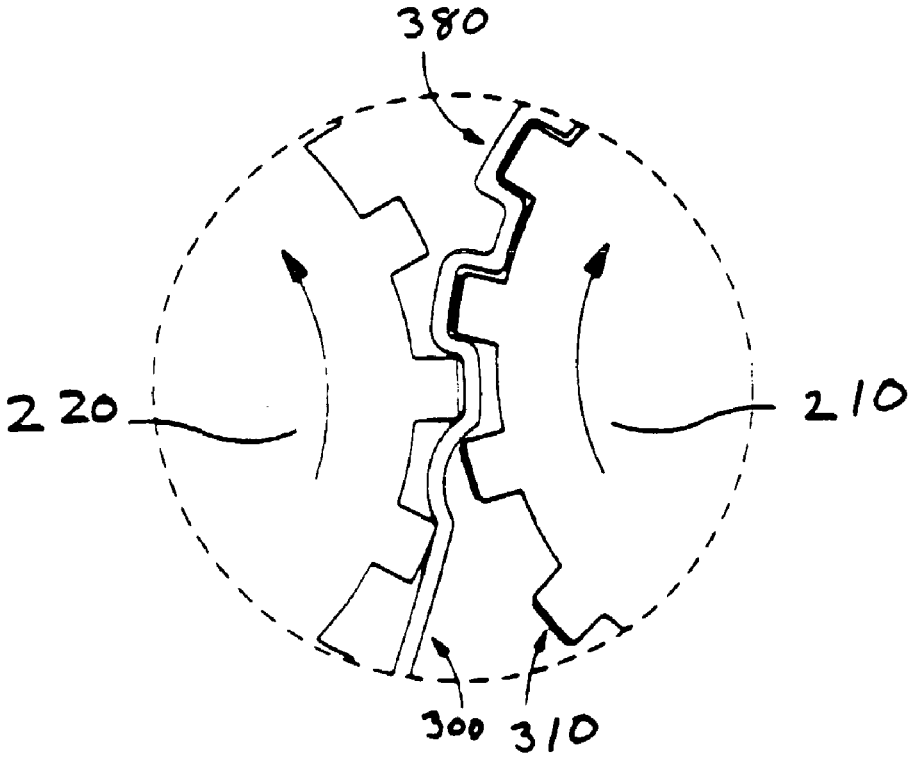
FIG. 3 is an enlarged partial view of the apparatus of the region labeled 3 of FIG. 2 illustrating the in-register embossing and adhesive application step between the embossing rolls.

As shown in FIG. 3, adhesive 310 is applied only to the land areas of the first embossing roll 210. This can be accomplished by carefully controlling the interaction between embossing roll 210 and final adhesive application roll 260 at station 360. The interaction between the first embossing roll 210 and the final adhesive application roll 260 should be controlled so that the final adhesive application roll 260 applies adhesive 310 to the lands of the first embossing roll 210 only, without pressing the adhesive 310 into the valleys between the land areas of first embossing roll 210. For this reason, first embossing roll 210 and final adhesive application roll 260 should also have matched surface speeds. Deposition of adhesive 310 exclusively onto the lands of the first embossing roll 210 prevents adhesive 310 from being transferred onto the non-recessed regions of the embossments in the finished embossed adhesive coated web 380. Adhesive present on the tops of the embossments (which can have various sizes and shapes) could cause premature exhibition of adhesive properties prior of the activation of the final product via crushing of the embossments, all as described in the commonly-assigned patents cited above.

As would be known of one of skill in the art, adhesive 310 can be any suitable adhesive, for example a styrenated block copolymer, such as H2630-08, manufactured by the Bostik Findley Corporation, Wauwatosa, Wis. To reduce the extension rate of the adhesive, the adhesive 310 is preferably first applied to a roll having a surface speed lower than the speed of the moving web of sheet material 300 and then through a series of metering nips (stations 330, 340, and 350) until adhesive 310 is reduced to a very thin film and accelerated at the desired tangential line speed.

It has been discovered that low adhesive thickness is preferred because the process is less prone to adhesive build up and manufacturing inefficiencies associated with adhesive build up. Surprisingly, good tack in the final finished product, in use, is maintained at even low adhesive thicknesses. A further benefit of reduced adhesive is the lower cost of purchased material and added inventory costs. An additional product benefit is that there is less stray adhesive in the product which tends to stick the layers together in a roll and making the product more difficult for the consumer to unwind.

Precise control over the adhesive 310, particularly the thickness and uniformity of the adhesive layer applied to the first embossing roll 210, is an important factor in producing a high quality product at high speed. Especially in the case of very low add-on levels of adhesive 310, even slight variations in the thickness of the adhesive 310 during transfers from roll to roll can result in coverage gaps by the time the adhesive 310 is applied to the first embossing roll 210. At the same time, such variations can lead to excess adhesive 310 in certain regions of the first embossing roll 210 which could either contaminate the recesses in the first embossing roll 210 or result in incomplete adhesive 310 transfer to the web of sheet material 300 and a buildup of adhesive 310 on the first embossing roll 210.

For the processes herein and as illustrated by reference to FIG. 2, preferably, the adhesive thickness ranges from about 0.00001 inches (about 0.00025 mm) to about 0.0003 inches (about 0.008 mm). More preferably, the adhesive thickness ranges from about 0.00003 inches (about 0.0007 mm) to about 0.0002 inches (about 0.005 mm). Further, it is believed that adhesive 310 should be applied to the web of sheet material 300 at a basis weight of less than about 3 g/m$^2$, and most preferably less than about 2 g/m$^2$. The adhesive application metering rolls 230–260, as well as first and second embossing rolls 210, 220, can be heated uniformly circumferentially and across the machine direction to avoid thermally-induced crown or runout of the rolls. In one exemplary embodiment, the first embossing roll 210 is internally cooled to a temperature that facilitates release of the adhesive-coated web from the embossing roll 210. Preferably, the embossed adhesive coated web 380 temperature is cooled at station 400 to less than about 180° F. (82° C.), more preferably less than about 140° F. (60° C.), and most preferably, less than about 100° F. (38° C.). In sum, a temperature differential should exist between the point of adhesive 310 pick-up at station 360 and the point of embossed adhesive coated web 380 removal from the first embossing roll 210 at station 400. The strip-off roll 280 assists in removing the embossed adhesive coated web 380 from the first embossing roll 210 without damaging the embossed adhesive coated web 380.

The use of mating second and first embossing rolls of complementary pattern shapes can fully support a thin film web of sheet material 300 during the embossing and adhesive application process step to ensure that the forces are properly distributed within the web of sheet material 300. Full support of the web of sheet material 300, as opposed to thermoforming or vacuum forming a web of sheet material 300 with an open support structure such as an apertured belt or drum wherein the portion of the web of sheet material 300 is deformed into the apertures or recesses is unsupported, is believed to allow an increase in the rate at which strains are imparted to the web of sheet material 300 without damage to the web of sheet material 300 thus allowing for higher production speeds. The application of the adhesive 310 to the web of sheet material 300 on the first embossing roll 210 provides precise registration of the adhesive 310 on the portions of the web of sheet material 300 over the land areas of the first embossing roll 210.

Additional information on the process disclosed in the second embodiment of the present invention, especially application of adhesive 310 to the web of sheet material 300 may be found in U.S. Pat. No. 6,193,918 issued on Feb. 27, 2001, to McGuire et al and assigned to Procter & Gamble.

Figure 4:
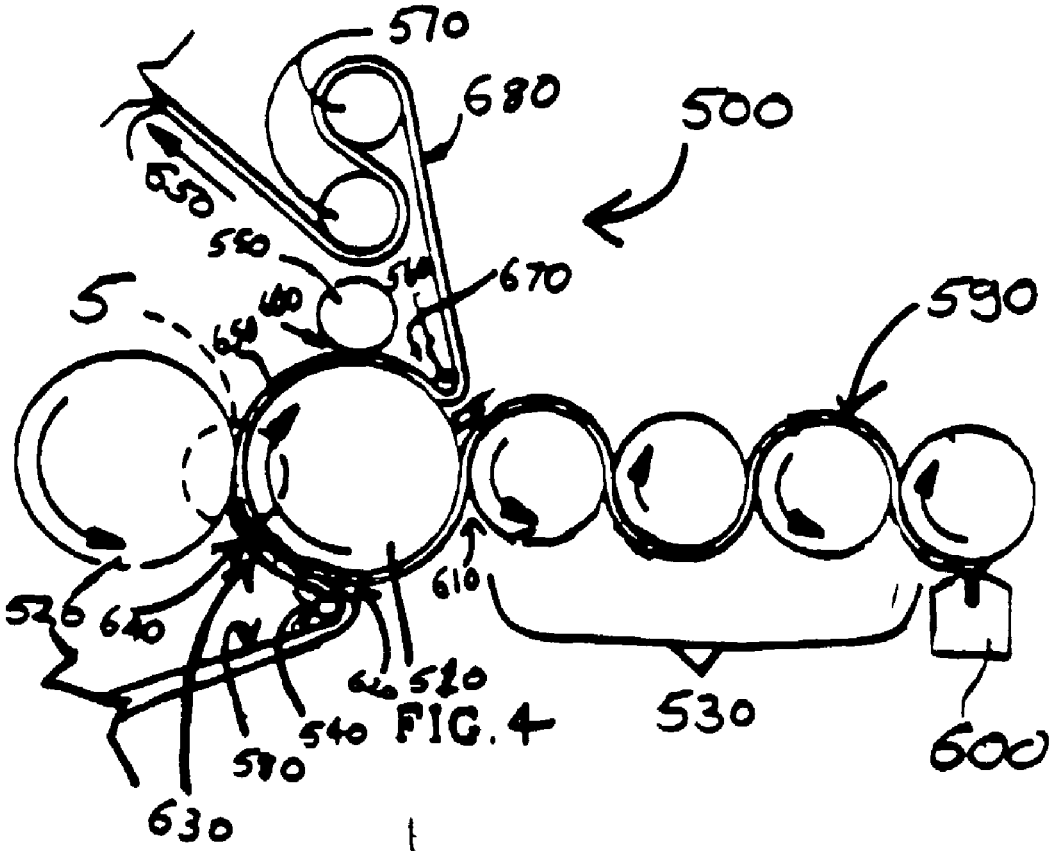
FIG. 4 is a schematic illustration of an embossing and adhesive printing process and apparatus according to the third aspect of the present invention.
Figure 5:
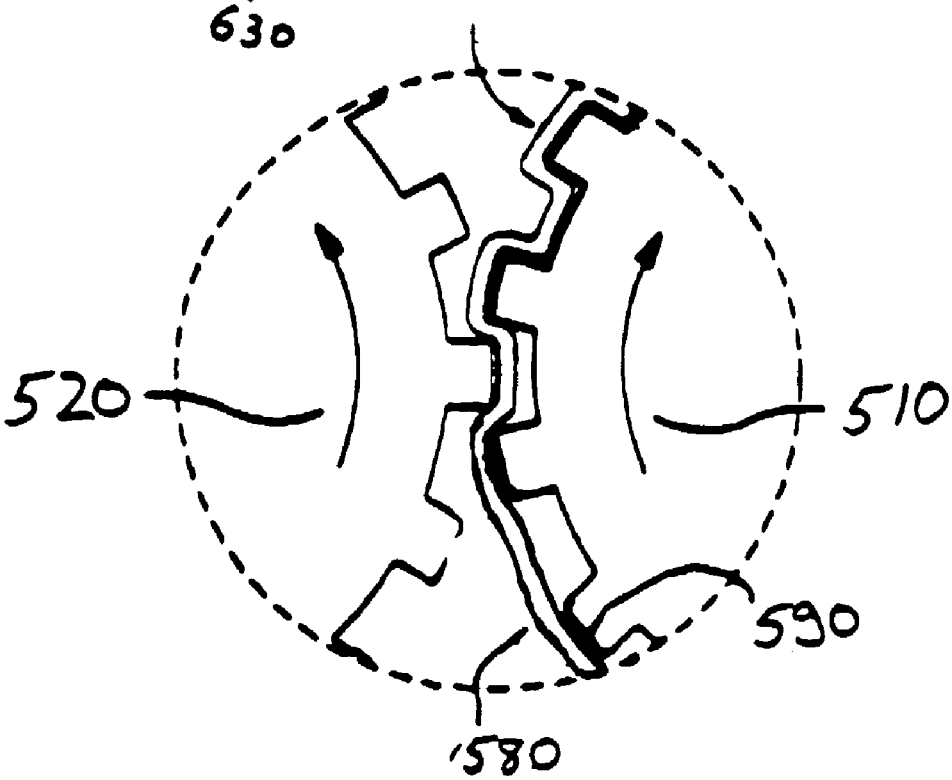
FIG. 5 is an enlarged partial view of the apparatus of the region labeled 5 of FIG. 4 illustrating the in-register embossing step between the embossing rolls.

The third embodiment of the present invention is directed to a method for embossing and applying adhesive to a web. FIG. 4 illustrates in schematic form a high speed embossing process and high speed embossing apparatus 500 of the third embodiment of the present invention. It will be readily apparent that the process illustrated in FIG. 4 is similar to that illustrated in FIGS. 2 and 3. The key difference between the processes illustrated by these different figures is that in the process illustrated in FIG. 4 the adhesive is applied to the substrate of sheet material by the first embossing roll and then passing the sheet between the first and second embossing rolls to emboss the sheet material; Whereas, the process illustrated by FIGS. 2 and 3 the adhesive is applied concurrently with the embossing step.

The high speed embossing apparatus 500 comprises first and second embossing rolls 510, 520, a plurality of adhesive metering application rolls 530, a web transfer roll 540, a pressure roll 550, a strip-off roll 560, and an S-wrap 570. The first and second embossing rolls 510, 520 have a complementary (i.e., matched) embossing pattern which interlocks to emboss the pattern onto a web of sheet material 580 passed therebetween. The embossing roll provided with valleys and land areas (connected) is generally referred to as the female or first embossing roll. The embossing roll with raised discrete, non-connected nubs is generally referred to as the male or second embossing roll.

The first embossing roll 510 is coated with adhesive, preferably from a multi-roll adhesive coater stack 530 and slot die 600, as described hereinbefore or by any other means known to those of skill in the art.

FIG. 4 depicts with arrows, an exemplary and non-limiting, direction of roll rotation for each roll. Exemplary, but non-limiting adhesives include hot melt, pressure sensitive, water-based, water-borne, solvent-based, ultraviolet and e-beam cured adhesives, and combinations thereof. It is preferred that slot die 600 be heated and supplied by a hot melt adhesive supply system, which can include a heated tank and variable speed gear pump (not shown) through a heated hose. However, it would be known to one of skill in the art that other methods to supply an adhesive 590.

The adhesive 590 is transferred from the adhesive application metering rolls 530 to the first embossing roll 510, located at station 610. The adhesive 590 travels on the surface of first embossing roll 510 to station 620, where adhesive 590 is combined with the web of sheet material 580 to form adhesive coated web 630. The adhesive coated web 630 then proceeds to station 640.

At station 640, the adhesive coated web 630 is embossed by first and second embossing rolls 510, 520 with the complementary embossing pattern thereon to form an embossed adhesive coated web 650. This results in the embossing pattern being in register with the adhesive pattern of first embossing roll 210. The embossed adhesive coated web 650, now adhered to the surface of the first embossing roll 510, next travels on the surface of first embossing roll 510 to station 660, where a pressure roll 550 applies pressure to the embossed adhesive coated web 650. The embossed adhesive coated web 650, still adhered to the first embossing roll 510, next travels to station 670, where it is removed from the first embossing roll 510 via strip-off roll 560. The finished embossed adhesive coated web 650 then travels to the S-wrap 570 at station 680. As would be known to one of skill in the art, the embossed adhesive coated web 650 can be further strengthened by supplying additional cooling to the embossed adhesive coated web 650 at stations 660 and 670.

Additional information on the process disclosed in the third embodiment of the present invention may be found in pending U.S. patent application Ser. No. 10/003,900, entitled "Storage Wrap Material," filed on Oct. 25, 2001, now abandoned (P&G Case 8762).

The substrate sheet may be any substrate which is suitable for use in an embossing and adhesive application process. Suitable substrates include, but are not limited to, metal foils, such as aluminum foil, wax paper or grease proof paper, polymeric films, nonwoven webs, fabrics, paper and combinations thereof. Some non limiting examples of polymeric films include, polyolefin films such as polyethylene including high density, linear low density, or low density; ethylene copolymers, such as ethylene vinyl acetate copolymers (EVA) or ethylene methyl acrylate copolymer (EMA), polyethylene terephthalate (PET), polyethylene terephthalate glycol copolymer (PETG); polypropylenes, polyethylene-propylene copolymers; nylon, and other polymeric films with similar properties.

Shore Hardness of the material is measured using Type A Shore Durometer according to a modified version of ASTM D2240 which is for use with rubber, rubberlike materials and soft plastics. The sample should be clean of foreign matter, smooth, and a minimum of 0.25 inch thick. The test is done at room temperature on a level, hard surface. An indentation device such as that available from PTC Instruments (Los Angeles, Calif.) incorporating the Type A Durometer scaled is pressed into the surface of the sample. The amount of indentation is read from the scale on the device, and the value is reported in Shore Type A hardness units.

The critical surface energy can be calculated by knowing the contact angle of various fluids in contact with a surface. The critical surface energy has two components, namely a dispersion (London forces) component and a polar (dipole-dipole) component. Specifically, a software package such as the SE2000 surface energy software package, that is supplied with instrumentation from AST Products (Billerica, Mass.), allows the user, knowing the contact angle of certain liquids with a surface to calculate the critical surface energy of a surface. In order to perform the calculation, it is necessary to obtain the contact angles of multiple liquids and know the dispersive and polar surface tension components of the standard liquids. The static contact angle is defined as the angle between the surface and the tangent line drawn to the droplet surface at the three phase point when a liquid drop is resting on a plane solid surface. (ASTM D5946 describes the contact angle measurement using water and treated films. A solvent of interest and the surface can be used in place of water and the treated film.). A sessile liquid drop on a surface will create a specific contact angle at the solid, liquid air interface based on the surface tensions. The contact angle is then measured from an enlarged profile of the sessile liquid drip and used by the software along with the contact angles measured for other standard liquids to calculate critical surface energy.

The dispersive and polar components for standard liquids are recorded in the software package. The dispersive and polar components for other liquids can be entered by the user.

In the present test the contact angle of three liquids (water, diidomethane, and ethylene glycol) is measured on a surface of interest. The contact angle is suitably measured using an automated contact angle gonionmeter, for example, such as a VCA 25000XE Video Contact Angle System from AST Products. The contact angle is the average of five droplets with a nominal value of 1 microliter.

In order to measure the contact angle using the 2500XE system, the following procedure is followed. Place the substrate of interest on the sample stage. Adjust the sample stage upward until the surface is just below the needle tip. Dispense 1 microliter of fluid from the syringe using the motorized syringe assembly and withdraw the stage to break the droplet from the syringe tip. Center the droplet in the filed of view. Adjust the image of the drop so that it is in focus and with good contrast. Capture the image for digital processing. Once the image has been obtained, five reference markers are digitally placed on the droplet by the user—L: left side at point of contact with surface, T: top of droplet at maximum height, R: right side at point of contact with surface, 1—on left side at half way to the top and 2—on right side at half way to the top. The user then instructs the software to calculate the contact angle.

Once the contact angle has been measured for three liquids, the critical surface energy is calculated using the Harmonic Mean Method. For a discussion on the derivation of the Harmonic Mean Method, please refer to A. J. Kinloch, "Adhesion and Adhesives: Science and Technology", Chapman & Hall, (1987), pp 18–32. The equations that are solved simultaneously in order to determine the critical surface energy of a surface are shown below:

$$(1+\cos\Theta_i)\gamma_i = 4\left[\frac{\gamma_i^d\gamma_s^d}{\gamma_i^d\gamma_s^d} + \frac{\gamma_i^p\gamma_s^p}{\gamma_i^p\gamma_s^p}\right]$$

$$\gamma_s=\gamma_s^p+\gamma_s^d$$

Where $\Theta_i$: measured contact angle of a given fluid with the solid surface;

$\gamma_i^d$ and $\gamma_i^p$: the dispersive and polar fluid surface tension components for the given fluid (known)

$\gamma_i$: surface tension of fluid equal to the sum of the dispersive and polar components (known)

$\gamma_s^d$ and $\gamma_s^p$: the dispersive and polar fluid critical surface energy components for the solid surface $\gamma_s$: critical surface energy of the solid surface.

Since $\gamma_i^d$ and $\gamma_i^p$ (dispersive and polar fluid surface tension components) are known, the surface free energy components $\gamma_s^d$ and $\gamma_s^p$ of the surface can be obtained for each pair of liquids using two equations (one for each liquid) and solving the equations simultaneously. Since there are three liquids that are used, there are three pairs of liquids that are used to calculate the critical surface energy (1,2), (2,3) and (1,3). The critical surface energy is the average of these three values. The SE-2000 software package performs this calculation once the contact angles have been entered.

The values for the dispersive and polar fluid surface tension components for the three fluids used to determine contact angle are given below:

| | $\gamma_i^d$ | $\gamma_i^p$ | $\gamma_i$ |
|---|---|---|---|
| Water | 22.1 | 50.7 | 72.8 |
| Diodomethane | 48.5 | 2.3 | 50.8 |
| Ethylene glycol | 29.3 | 19.0 | 48.3 |

As noted above, these values in combination with the measured contact angles can be used to simultaneously solve the equations defined above to define three estimates of the critical surface energy. These estimates are averaged to arrive at the reported critical surface energy.

The peel force of the adhesive from the sample is measured using a modified version of ASTM D3330. A test adhesive film is prepared as follows. A hot melt pressure sensitive adhesive, H2630, from Bostik Findley is coated onto a 2 mil (50 micron) thick substrate of Mylar® oriented polyester (OPET) at 30 gsm. The adhesive side of the resulting adhesive film is covered with a silicone release paper. The adhesive film is cut into 1 inch×10 inch strips. The release paper is peeled off and the adhesive film strips are placed on the surface to be tested and rolled with a 2 in wide elastomeric roller with a Shore 60A hardness that has a weight of 4.5 lbs at a speed of 12 in/min over a distance of at least 5 inches. The adhesive film strips are allowed to equilibrate at room temperature for 15 minutes prior to testing. The sample and adhesive film strips are placed in the two grips and peeled at a 180° angle at a speed of 12 inches/minute using an Instron® tester over a distance of 3 inches. The average force required to peel the adhesive film strips from a distance of 1 to 3 inches is recorded. The result is an average of three samples.

Taber abrasion is used to give an indication of the ability of the material to resist abrasive wear according to ASTM D4060. The Taber abrader and supplies are available from Taber Industries (Tonawanda, N.Y.). A 4 inch×4 inch sample with a minimum thickness of 0.125 inch with a hole drilled in the middle is mounted to a sample card and placed on the machine. The two H-18 grinding wheels, which have a 1000 g weight attached to each side, are placed on the surface of the sample. The sample is rotated for 1000 cycles. Any debris is removed using forced air. The weight loss is measured in milligrams.

Average surface roughness, $R_a$, is the average height of the surface and is obtained using optical profilometry such as with a Zygo (Middlefield, Conn.) NewView 5030 Scanning White Light Interferometer using a 2× image zoom and a 5× Low-Reflectivity Michelson Objective. The equipment uses noncontact scanning white light interferometry to acquire the sample image or roughness profile, R. The minimum scan length is 40 microns. The instrument obtains the $R_a$ by calculating the arithmetic mean of the roughness profile, R, and reports it in microinches or microns. Hand-held units, such as an Optical Check (Lake Forest, Calif.) Lasercheck® surface roughness gage, are readily available that display the $R_a$ value after contacting the unit with the surface.

EXAMPLES

Example 1

TDT 308 urethane is used as the base resin. 29 wt % of Resin Modifier 4-7051 (Dow Corning, Midland, Mich.) is blended into the resin and cures at room temperature. The 4-7051 is a powder of high viscosity silicone that is functionalized with epoxy to improve compatibility. The wear properties and peel strength show a dramatic improvement compared to the control.

Comparative Example 1

Crosslinked silicone microspheres, Tospearl® 145, from GE silicones are blended at 29 wt % into TDT 308 urethane and cured to form a 4 inch×4 inch×0.125 inch plaque. It shows a high peel strength and no improvement in Taber abrasion values.

Example 2

A polyether urethane, KAS44208ATS from Kastalon (Chicago, Ill.) containing fugitive silicone and 10 wt % fluoropolymer particles is cast onto a 4 inch diameter roll with a thickness of from about 0.15 inch to about 0.125 inch, ground to a thickness of 0.125 inch and laser engraved with a random pattern. The first roll is mated with a second roll and is able to make acceptable embossed adhesive containing product with no visible adhesive residue remaining on the first roll.

Example 3

A urethane, PET 91A, available from Air Products is blended with 10 wt % of Dow Corning DC200, 20 cst viscosity silicone fluid is cast and formed into a roll. The roll is ground to diameter and a pattern is laser engraved. The roll is mated with a corresponding second roll and the process is run producing a 1,000,000 meters of product before adhesive started to remain on the roll.

Comparative Example 2

Duralease® 2096 is a chlorosulfonated polyethylene with a Shore A hardness of 85. The material shows high Taber abrasion and high peel strength leading to residual adhesive on the plaque and is not suitable for this application.

Comparative Example 3

The TDT 308 urethane base is blended with 23 wt % synthetic 2 micron graphite powder and cures to form a 5 inch×5 inch×0.125 inch plaque. The sample shows poor abrasion resistance and high peel strength with adhesive residue after peeling making it unsuitable for the current process or element.

Example 4

Teflon® fluorinated ethylene propylene (FEP) film shows excellent release properties and good durability. An FEP sleeve is heat shrunk onto a 6 inch diameter steel roll which provided excellent release of the adhesive and no residue remained after applying the film strips described hereinabove.

Example 5

A two part silicone urethane copolymer consisting of 10% silicone in the urethane backbone is applied to a 4 inch diameter steel roll at a thickness of 0.25 inch and is ground to tolerance. The roll is laser engraved with a pattern. The roll is run in combination with a steel unembossed roll. The roll allows release of the adhesive for 70,000 meters with good adhesive continuity and no adhesive residue.

TABLE 1

Summary of Taber Abrasion weight loss and peel strength of pressure sensitive tape to various elastomers

| ID | Material | Taber Weight loss (mg) | Peel strength (g/in) |
|---|---|---|---|
| | TDT-308 urethane (control) | 410 | 1300 |
| C1 | 29 wt % Tospearl 145 | 800 | 1500 |
| C2 | Duralease 2096 | 583 | 960 |
| C3 | TDT-308 with graphite | 387 | 1600 |
| 1 | 29 wt % Dow Corning 4-7051 | 110 | 140 |
| 2 | Urethane with fugitive silicone | 91 | 2 |
| 3 | Omni urethane + 10 wt % silicone oil | 28 | 8 |
| 4 | FEP | 110 | 34 |
| 5 | Silicone-urethane copolymer | 57 | 46 |

While particular embodiments of the present invention have been illustrated and described, it will be readily apparent to those skilled in the art that various changes and modifications may be made without departing from the spirit and scope of the invention, and it is intended to cover in the appended claims all such modifications that are within the scope of the invention.

What is claimed is:

1. A patterned element for use in an embossing and adhesive application process, said patterned element whose surface comprises a material having a pattern disposed thereon, said material comprising a polymer and has a Shore A hardness of greater than about 70, a surface roughness of less than about 30 microinches (0.8 microns) and has a critical surface energy of less than about 30 dynes/cm.

2. The patterned element according to claim 1 wherein said material has a peel force of less than about 500 g/inch, a Taber abrasion weight loss of less than about 300 mg, wherein said element is patterned by laser engraving.

3. The patterned element according to claim 1 wherein said material further comprises from about 2% to about 50% by weight of a critical surface energy reducer.

4. The patterned element according to claim 3 wherein said critical surface energy reducer is selected from the group consisting of oils, waxes, gums, resins, particles containing silicone and/or fluorine and combinations thereof.

5. The patterned element according to claim 1 wherein said polymer is selected from the group consisting of silicones, fluoropolymers, polyurethane, nitrile rubbers, isoprene rubber, thermoplastic elastomers, EP rubber, SER, EPDM, epoxides, polychloroprene and mixtures thereof.

6. The patterned element according to claim 5 wherein said polymer is copolymers containing silicone and/or fluorine.

7. The patterned element according to claim 1 is selected from the group consisting of a roll and a continuous belt.

8. The patterned element according to claim 1 wherein said material surrounds a curved body of a cylindrical core.

* * * * *